US007748921B2

(12) United States Patent
Puczkowski

(10) Patent No.: US 7,748,921 B2
(45) Date of Patent: Jul. 6, 2010

(54) FLUID APPLICATOR ASSEMBLY

(75) Inventor: Michael B. Puczkowski, Cleveland, OH (US)

(73) Assignee: Trac-Tool Products, LLC, Cleveland, OH (US)

( * ) Notice: Subject to any disclaimer, the term of this patent is extended or adjusted under 35 U.S.C. 154(b) by 962 days.

(21) Appl. No.: 10/583,075

(22) PCT Filed: Dec. 15, 2004

(86) PCT No.: PCT/US2004/042066

§ 371 (c)(1),
(2), (4) Date: Jun. 15, 2006

(87) PCT Pub. No.: WO2005/058510

PCT Pub. Date: Jun. 30, 2005

(65) Prior Publication Data

US 2007/0147945 A1 Jun. 28, 2007

Related U.S. Application Data

(60) Provisional application No. 60/530,097, filed on Dec. 16, 2003.

(51) Int. Cl.
*B43M 11/02* (2006.01)

(52) U.S. Cl. ..... 401/220; 401/218; 401/219

(58) Field of Classification Search ..... 401/208, 401/218, 219, 220
See application file for complete search history.

(56) References Cited

U.S. PATENT DOCUMENTS

| | | | | |
|---|---|---|---|---|
| 2,955,310 | A | | 10/1960 | Wichern |
| 3,015,837 | A | | 1/1962 | Teall |
| 3,195,170 | A | | 7/1965 | Howard |
| 3,421,822 | A | | 1/1969 | Roche |
| 3,427,115 | A | * | 2/1969 | Jolly ..... 401/219 |
| 3,937,583 | A | | 2/1976 | Tyson et al. |
| 4,222,678 | A | | 9/1980 | Miller |
| 4,422,789 | A | | 12/1983 | Charney et al. |
| 4,537,522 | A | | 8/1985 | Charney et al. |
| 4,566,816 | A | | 1/1986 | Janssen |
| 5,614,021 | A | * | 3/1997 | Catlin ..... 118/258 |
| 5,702,525 | A | | 12/1997 | Liou |
| 5,853,258 | A | | 12/1998 | Woodruff |
| 5,857,795 | A | | 1/1999 | Liou |
| 5,931,595 | A | | 8/1999 | Van Oost |
| 6,045,282 | A | | 4/2000 | Begin |
| 6,141,821 | A | | 11/2000 | Chin |
| 2003/0021623 | A1 | | 1/2003 | Harper |

OTHER PUBLICATIONS

International Search Report dated May 11, 2005.
Written Opinion of the International Searching Authority (Form PCT/ISA/237) dated May 11, 2005.

* cited by examiner

*Primary Examiner*—David J Walczak
(74) *Attorney, Agent, or Firm*—Fay Sharpe LLP

(57) ABSTRACT

A fluid applicator assembly can include a frame, a first roller connected to the frame, a second roller connected to the frame, a fluid supply tube connected to the frame, a supply line, and a handle bar pivotally connected to the frame. The second roller is connected to the frame in spaced relation from the first roller. The supply tube connects the frame to the first roller and includes a discharge opening. The fluid supply line communicates with the fluid supply tube and an associated paint source. The handle bar is adapted to attach to an associated handle for maneuvering the assembly.

13 Claims, 3 Drawing Sheets

FLUID APPLICATOR ASSEMBLY

This application claims the benefit of provisional patent application Ser. No. 60/530,097 filed Dec. 16, 2003, which is incorporated by reference.

BACKGROUND

Known methods of painting use a conventional roller assembly, for example, a roller such as a cardboard or plastic having an absorbent material such as nylon, reticulated foam, felt, lambswool or a sponge that temporarily holds a liquid (e.g. paint) until the liquid is applied to a work surface. This is widely used to cover large surface areas typically where not much trim or detail painting is required.

Still another method is to modify the conventional roller so that it receives paint under relatively high pressure through the cylindrical roller and permeates the inner surface of the absorbent material where it passes to the external surface thereof for application to an associated work surface. Known pressure roller assemblies supply paint to an internal passage of the roller at pressures of approximately 1000 psi.

Known pressure roller assemblies generally include a roller tube, a paint distributor, an auger, and a roller. The roller is similar to a conventional cylindrical paint roller; however, the roller must be able to allow paint to be delivered from inside the roller and travel to an outer surface of the roller. Such a construction makes these rollers more expensive than conventional rollers. The auger is received by the roller and advances the paint within the hollow portion of the roller. The paint distributor is received by the auger and the roller. The paint distributor typically is a cylindrical member having a plurality of holes through which the paint travels towards the auger and the roller. This subassembly, which includes the roller, the auger, and the paint distributor, is sealed at each end by an end cap. The subassembly is then mounted on a roller tube, which is hollow so that paint can flow through the tube toward the subassembly. Paint travels through the tube and into the subassembly under pressure that can be as great as 1000 psi.

Such pressure roller assemblies as described above allow an operator to typically cover more surface area during an application job than a conventional paint roller. Nevertheless, many drawbacks are attributed to these pressure roller assemblies. First, the known assembly operates at high pressures, which can cause stress to the components of the assembly as well as fatigue to the operator due to the high pressure working against the operator. The known assembly also requires a special roller that includes small fluid ports that can become blocked resulting in a malfunctioning painting apparatus. Also, the roller can become saturated resulting in splatter and drips during the painting process. Known pressure rolling assemblies also include many sealed wear parts that can become worn and leak.

Known pressure rolling assemblies also do not include splatter guards and can be very difficult and time consuming to clean. Furthermore, the paint distribution in the pressurized painting apparatus can also be uneven. Accordingly, it is desirable to provide a painting apparatus that overcomes the shortcomings mentioned above.

SUMMARY OF THE INVENTION

According to one present embodiment, a fluid applicator assembly includes a frame having a first roller mount and a second roller mount, a rotatably adjustable fluid supply tube connected to the frame, and a shield connected to the frame.

The first roller mount and second roller mount are spaced from one another so that two rollers can mount to the frame having their central axes spaced from one another. The fluid supply tube connects to the frame spaced from the first roller mount and is adapted to communicate with an associated fluid source.

An embodiment of a fluid applicator assembly can also include a frame, a first roller connected to the frame, a second roller connected to the frame, a fluid supply tube connected to the frame, a supply line communicating with the fluid supply tube, and a handle bar pivotally connected to the frame. The second roller connects the frame spaced from the first roller. The fluid supply tube connects to the frame spaced from the first roller and includes a discharge opening. The fluid supply line communicates with the fluid supply tube and an associated paint source. The handle bar is adapted to attach to an associated handle for maneuvering the assembly.

A low pressure fluid applicator system includes a fluid applicator assembly, a handle, a valve and a fluid source container. The fluid applicator assembly includes a frame, a first roller rotatably mounted to the frame, a second roller rotatably mounted to the frame, a fluid supply tube mounted to the frame, and a handle bar pivotally connected to the frame. The handle attaches to the handle bar and includes an internal passage in communication with the fluid supply tube. The valve selectively opens and closes the internal passage of the handle. The fluid source container communicates with the internal passage of the handle.

DETAILED DESCRIPTION

Figure 1:
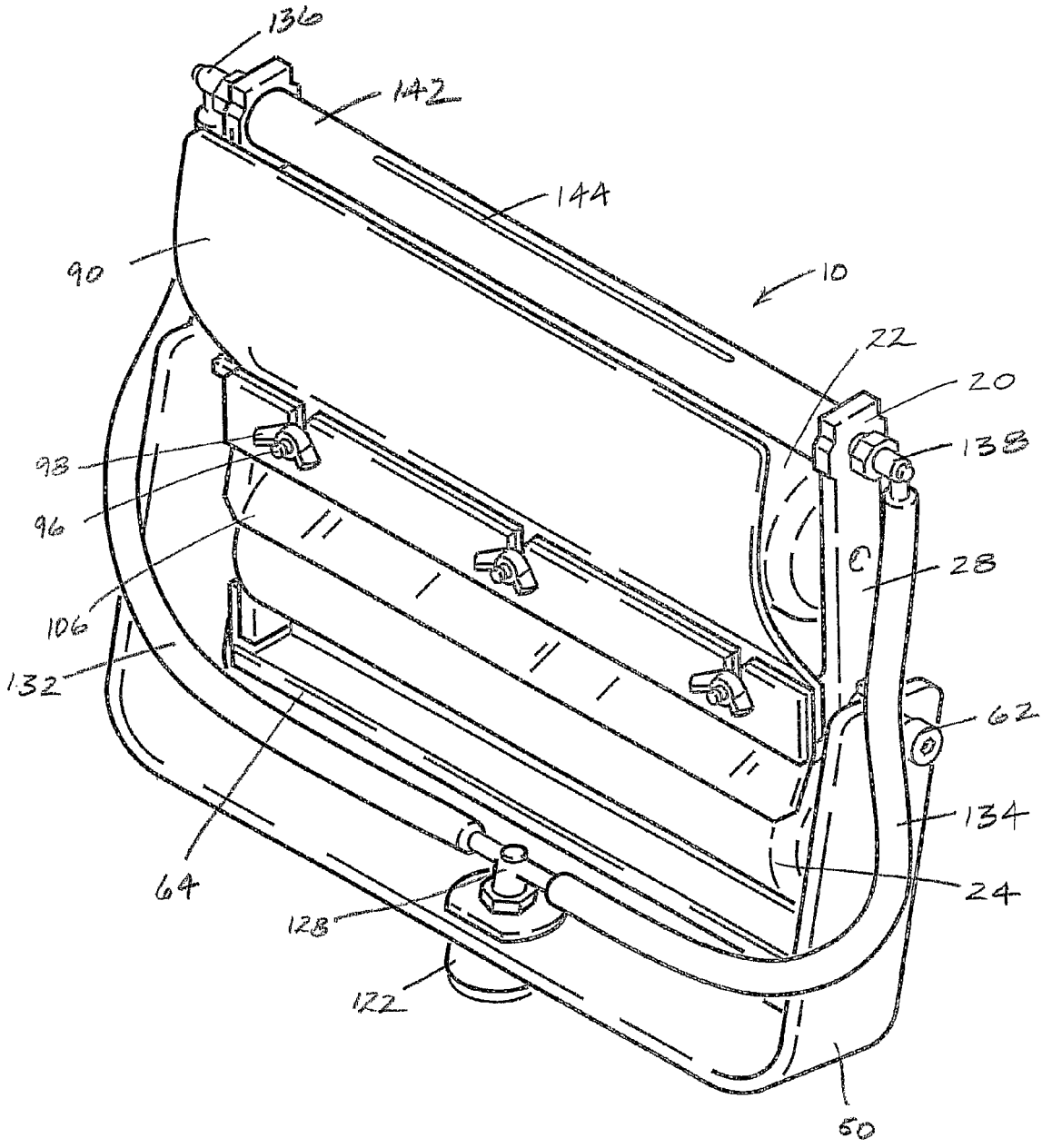
FIG. 1 is a rear perspective view of a fluid applicator assembly.
Figure 2:
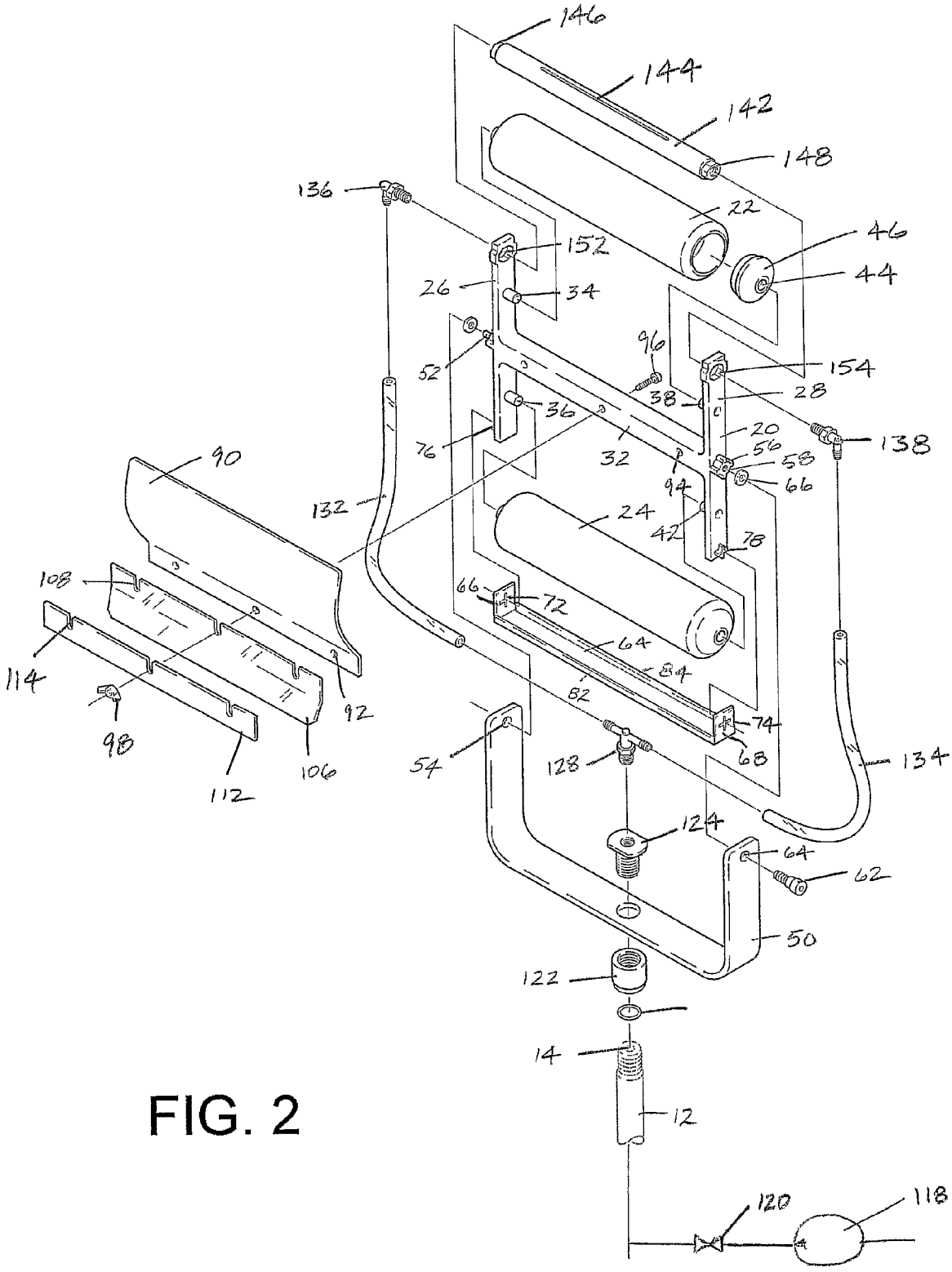
FIG. 2 is an exploded view of the fluid applicator assembly of FIG. 1.
Figure 6:
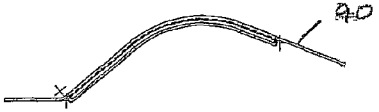
FIG. 6 is a cross-sectional view of FIG. 4 taken along line A-A.
Figure 4:
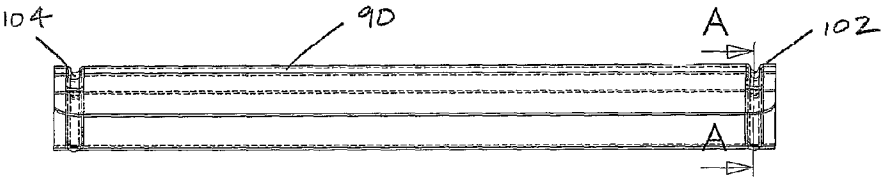
FIGS. 3-5 are plan, front elevation, and end elevation views, respectively, of a shield having corrugations for use with the fluid applicator assembly of FIG. 1.
Figure 3:
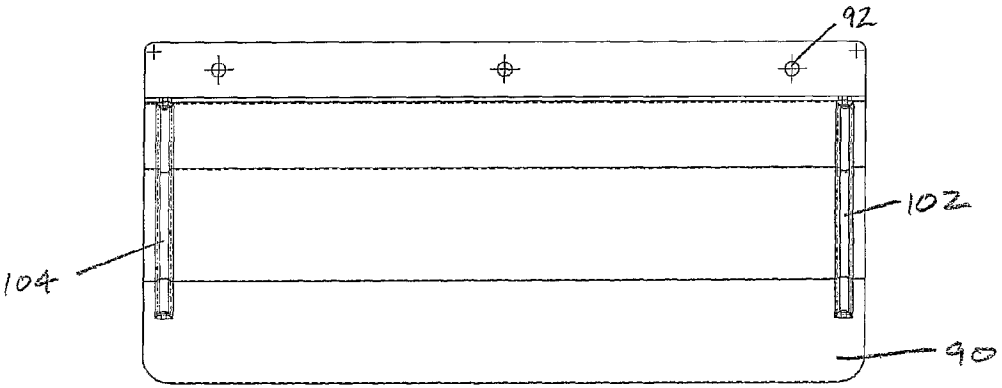
Figure 5:
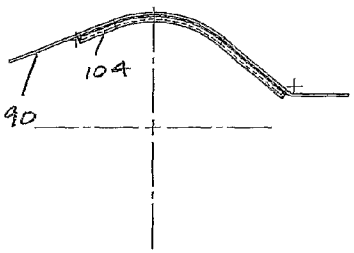

With reference to FIGS. 1 and 2, a fluid applicator assembly 10 attaches to a handle 12 having an internal passage 14 that communicates with a fluid supply. The fluid applicator assembly 10 will be described with reference to applying paint to a surface; however, it is to be understood that the assembly can be used to apply any conventional fluid or liquid to a surface, including, but not limited to, stain, primer, sealant, cleaner, adhesive, pesticide, herbicide, etc. The handle 12, which is generally known in the art, typically includes a valve that can selectively open and close the passage 14 to control the flow of fluid through the handle. The pressure at which the fluid is under in the fluid applicator assembly can be much less (typically less than 50 psi) than the pressure at which paint is under in known pressure applicators. Typically in a present embodiment, the paint or liquid is delivered as measured by gallons per minute, and the pressure at which the paint or liquid is delivered is determined by the characteristics of the paint or liquid and the path through which it travels. The paint or liquid, for example, can be delivered at about 0.25 to about 0.28 gallons per minute. Delivering the paint or liquid at lower pressures allows the fluid lines and other fluid assemblies to have larger diameters (nominally about ⅜"-1"), which lessens the likelihood of clogs or blockage in the fluid lines. Lower pressures also reduce the stress on the components of the assembly as well as limit fatigue to the operator caused by the pressure of the fluid through the handle.

According to the depicted embodiment, the fluid applicator assembly 10 includes an H-shaped frame 20, a first roller 22 mounted to the frame, a second roller 24 mounted to the frame, and a fluid supply assembly for supplying fluid to the rollers. Throughout the specification, the first roller 22 may be referred to as the upper roller and the second roller 24 may be referred to as the lower roller. This is simply for ease of understanding the figures and is not used to limit the assembly to any certain configuration. The rollers in the depicted embodiment are any conventional 9" rollers; however, the H-shaped frame 20 can be made to accommodate rollers from 2 inches to 36 inches, for example, in length. Also, not only can rollers mount to the frame, other items such as cloth pads and the like can mount to the frame.

With reference to FIG. 2, the frame 20 is a molded plastic component having two parallel side rails, first side rail 26 and second side rail 28, that are interconnected by a cross member or strut 32. A first upper roller mount 34 extends from the first side rail 26 towards the second side rail 28 and is disposed above the strut 32 as the assembly is depicted in FIG. 2. A first lower roller mount 36 also extends from the first side rail 26 towards the second side rail 28, but is located below the strut 32. A second upper roller mount 38 and a second lower roller mount 42 extend from the second side rail 28 toward the first side rail 26. The side rails 28 are sufficiently resilient such that they can be pulled apart from one another to allow for the mounting and removal of the rollers 22 and 24 from the frame 20, yet sufficiently rigid to maintain the. rollers on the frame while painting. The roller mounts in the illustrated embodiment are cylindrical protrusions that are dimensioned to receive openings 44 in end caps 46 that attach to the respective rollers 22 and 24. In alternative embodiments, the rollers can attach to the frame in other conventional manners, via pins, axles, fasteners and the like; however removal of the rollers without the need for hand tools, which can be done in the illustrated embodiment, is desirable. The upper roller mounts 34 and 38 are aligned with one another to define an axis about which the upper roller 22 rotates. Likewise, the lower roller mounts 36 and 42 are aligned with one another to define an axis about which the lower roller 24 rotates. The axes in which the rollers rotate are spaced from the lowermost and uppermost ends of the frame 20 at least a distance greater than the outer radius of a conventional roller, which protects the rollers from inadvertently contacting the ceiling or the floor, for example, when painting a wall. The axes are also parallel to one another and reside in the same plane so that both rollers can contact the work surface at the same time.

A U-shaped handle bar 50 mounts to the frame 20 such that the handle bar 50 can pivot in relation to a central axis of the strut 32 of the frame. A pin 52 extends from the frame 20 aligned with the central axis of the strut 32. The pin 52 is received in a first attachment opening 54 at a first end of the handle bar 50. A boss 56 defining an opening 58 concentric with the central axis of the strut 32 receives a shoulder bolt 62 that is also received in a second opening 64 of the handle bar 50. Accordingly, the handle bar 50 is pivotally attached to the frame 20 to rotate about the central axis of the strut. Alternatively, the handle bar 50 can attach to the frame 20 in other conventional manners.

A drip guard 64 attaches to a lower end of the frame 20. The drip guard 64 includes first and second end walls 66 and 68 each having an opening 72 and 74, respectively. The openings 72 and 74 receive correspondingly shaped projections 76 and 78 on the frame 20. In the depicted embodiment, the projections 76 and 78 are cross-shaped members and the openings 72 and 74 are also cross shaped. This configuration provides four bearing regions for the connection between the drip guard 64 and the frame 20. Since the side rails 26 and 28 are resilient, they can be flexed towards one another so that the projections 76 and 78 can be inserted into the corresponding openings 72 and 74 to attach the drip guard 64 to the frame. The drip guard 64 can attach to the frame in other conventional manners, including fasteners, welding, etc; however, a drip guard that is removable without the need for hand tools, such as the drip guard 64 in the depicted embodiment, allows for easier disassembly and cleanup. The drip guard 64 also includes side walls 82 and 84 that can retain paint that falls onto the drip guard 64. The drip guard 64 can also provide another guard function where the drip guard protects the lower roller 24 from inadvertently contacting a surface that is at an angle, which will typically be perpendicular, to the surface being painted.

A first roller shield 90 attaches to the frame 20. The first shield 90 catches paint that splatters off the first roller 22. The shield 90 includes a plurality of fastener openings 92 that align with openings 94 in the strut 32 of the frame 20. Fasteners 96 extend through the openings 94 and 92 and receive a wing nut 98 to attach the shield 90 to the frame 20. The wing nut and fastener connection allows for easy removal of the shield 90 from the frame 20. The upper shield 90 has a length that is generally equal to or slightly longer than the length of the first roller 22.

The shield 90 is curved to complement the shape of the first roller 22 and an upper portion of the shield 90 flattens out to become generally planar. As seen in FIGS. 3-6, the shield 90 can include corrugations 102 and 104 that are spaced on opposite ends of the shield 90. The corrugations 102 and 104 are parallel to one another and spaced from one another a distance equal to the length of the first roller 22. Not only do the corrugations 102 and 104 provide stiffness to the shield 90, which will be typically made from metal, but the indentions that extend toward the first roller 22 can catch any dripping or splattering of paint from the first roller 22 when the applicator device is used to apply paint in a horizontal direction. The corrugations 102 and 104 can also direct any excess liquid that contacts the shield 90 towards the lower roller 24 and/or the drip guard 64.

A second shield or lower guard 106 depends from the strut 32 and acts as a splatter shield for the lower roller 24. The lower guard includes a plurality of notches 108 that align with the openings 92 in the first shield 90 and the openings 94 in the strut 32 to receive the fastener 96. In the depicted embodiment, the lower shield 106 bends away from the strut 32 and is positioned close to the outer surface of the lower roller 24. The lower guard 106 also has a length that is at least approximately equal to the length of the lower roller 24. In an alternative embodiment, the lower shield 106 can be replaced by a wiper that contacts the lower roller 24 to remove any excess paint that builds up on the lower roller 24. The shields described above can also be formed as a single component, if desired.

A hold down bracket 112 attaches to the strut 32 of the frame 20 to retain the first shield 90 and the second shield 106. The hold down bracket 112 includes a plurality of notches 114 that align with notches 108 in the second shield 106 and openings 92 in the first shield 90 so that fasteners 96 can be received in the openings 94 and the strut 32 and the hold down bracket 112 can retain the first and second shields.

As mentioned above, the handle 12 includes a passage 14 through which fluid can be delivered to the assembly 10. As depicted schematically in FIG. 2, a pump and fluid source 118 delivers fluid to the passage 14 defined in the handle 12. Even though a pump, which could be any conventional pump that can deliver the fluid, has been described for supplying the fluid, a gravity fed system, for example a container carried as a backpack, may also be used as a fluid source, especially where a low viscosity fluid is being delivered to the apparatus. The handle 12 can be any conventional handle where the delivery of paint can be controlled. A valve 120 can selectively open and close to control delivery of the paint. An external fluid line can also be used to provide fluid to the assembly. The arrangement depicted, however, incorporates a passage within the handle so that the handle provides sufficient strength to protect the fluid delivery.

The handle 12 typically includes a threaded end that fits into a bulk head fitting nut 122. The bulk head fitting nut 122 is hollow to receive the handle 12 at one end and a bulk head fitting 124 at the other end. The bulk head fitting nut 122, in the depicted embodiment, is a left handed nut so that the handle 12 can be tightened into the nut in a position where a trigger (not shown), which controls the valve 120, is most comfortable for the person using the assembly.

A tee fitting 128 fits into the bulkhead fitting 124 and communicates with the pump/fluid source assembly 118. First and second fluid supply lines 132 and 134 connect to and communicate with the tee 128. The first fluid supply line 132 attaches to the tee 128 at one end and to a first elbow fitting 136 at the opposite end. Similarly, the second fluid line 134 attaches to the tee 128 at one end and to a second elbow fitting 138 at the opposite end. The fluid supply lines 132 and 134 can be made from a very flexible plastic having a high memory to allow the U-shaped handle 50 to pivot in relation to the frame 20 nearly 180 degrees while still allowing paint to flow through the lines. The first elbow 136 attaches to and communicates with a supply tube or member 142 at a first end and the second elbow 138 attaches to and communicates with the supply tube 142 at a second end. The elbow fittings 136 and 138 and the tee fitting 128 are made to allow for connection of the fluid supply assembly that does not require hand tools, which is possible because the fluid traveling through the lines is not under a great amount of pressure. Each fitting includes a plurality of cylindrical ramps or barbs that incline upward in the direction that the supply line is pressed onto the fitting. The elbow fittings 136 and 138 also include a threaded end that is threaded into a threaded receptacle in the supply tube 142. Other types of low pressure connections can be used instead of the aforementioned, for example the elbow fittings may be replaced and the supply lines can attach directly to the supply tube.

The supply tube 142, which can be made from a rigid plastic, includes an elongated slot 144 through which fluid is dispensed. The fluid supply tube is depicted as a hollow cylinder; however, the tube can take a number of different configurations that allow fluid to be dispensed for use with the assembly. The elongated slot runs parallel to the axes in which the rollers 22 and 24 rotate. Instead of a single elongated slot 144, the supply tube can include a plurality of spaced openings through which fluid can exit the supply-tube. Paint travels from the fluid source through the handle 12, through the bulkhead nut 122 and fitting 124 into the tee 128. From the tee 128, fluid travels through the first and second supply lines 132 and 134, through the elbow fittings 136 and 138, respectively, into the fluid supply tube 142 and out the elongated slot 144. Since the fluid travels under low pressure, the supply lines, fittings and supply tubes can have relatively large diameters, as compared to known pressure assemblies. In the illustrated embodiment the supply lines, fittings and supply tube can have an internal diameter of about ⅜"; however a range of diameters from ⅛" to ⅞" and even larger are contemplated.

The supply tube 142 is adjustable. In the depicted embodiment, the supply tube 142 includes first and second polygonal ends 146 and 148, which in the depicted embodiment are octagonal. The frame includes first and second polygonal openings 152 and 154 formed in the side rails 26 and 28, respectively that have a complementary shape to the ends of the supply tube. With such a configuration and since the side rails 26 and 28 are flexible, the supply tube 142 is able to rotate and lock into a number of different orientations, which are equal to the number of sides provided in the polygonal end, e.g. three different orientations for a triangular end and eight different orientations for an octagonal end. To rotate the supply tube 142, the side rails 26 and 28 are pulled away from the polygonal ends so that the polygonal ends are no longer located inside the complementarily shaped openings. The supply tube 142 is then rotated to a new orientation. Afterwards the side rails are allowed to return to their normal location with the polygonal end received in the complementarily shaped opening. Accordingly, the location of the elongated slot 144 in relation to the first roller 22 can change. Since the assembly operates as a low pressure system, fluid discharges from the elongated slot 144 and travels over the outer surface of the supply tube 142 towards the first roller 22 when the elongated slot is in the position depicted in FIG. 1. As the fluid travels over the supply tube 142 it can fan out towards the ends of the first roller 22, which provides more even application of the fluid on the work surface. If fluid is being applied to a horizontal surface, e.g. a floor, the supply tube 142 can be rotated so that the slot 144 is positioned to deposit fluid directly on the floor, or so that the fluid must travel over the outer surface of the supply tube before contacting the floor.

The supply tube 142 is spaced from the upper roller 22 so that the upper roller can rotate, but the spacing can be minimal if desired. The wall thickness of the supply tube 142 or the location of the supply tube can be changed to adjust the location of the slot 144 with respect to the upper roller 22. The supply tube 142 connects to the frame 20 slightly below the uppermost end of the frame, which allows the frame to contact the ceiling, when a wall is being painted, before the supply tube contacts the ceiling. Typically when painting a vertical wall the slot 144 will be in the 12 o'clock position vertically above the upper roller and the frame 20 provides a standoff that precludes the supply tube 142 from contacting the ceiling on an upstroke. The upper shield 90, described above, also ends below the uppermost end of the frame 20 so that the shield does not contact the ceiling and bend towards the supply tube 142. Even though the upper and lower standoffs are depicted as integral parts of the frame 20 in the illustrated embodiment, in alternative embodiments, the standoffs can simply attach to the frame, the handle bar 50 or other member, so long as they inhibit incidental contact of a roller and/or supply tube with an undesired surface.

In lieu of the upper roller 22 being externally fed, as depicted in FIGS. 1 and 2, the supply tube 142 can be inserted into the upper roller 22 and the roller could be internally fed. With such a configuration, however, the roller 22 would need to be of the type that would allow fluid to pass to an outer surface of the roller.

The fluid applicator assembly has been particularly described to allow one skilled in the art to make and use the invention and to disclose the best mode. The description was not intended to limit the invention to only those embodiments that have been described. Instead, the invention is limited only by the appended claims and the equivalents thereof.

The invention claimed is:

1. A low pressure fluid applicator system comprising:

a fluid applicator assembly including a frame;

a first roller rotatably mounted to the frame;

a fluid supply member mounted to the frame including a discharge outlet, the fluid supply member being mounted spaced from the first roller and being adjustable with respect to the frame between at least a first position where fluid exits the discharge opening and flows over an outer surface of the fluid supply member toward the first roller and a second position where fluid exits the discharge opening and falls onto a surface to which fluid is to be applied;

a handle bar pivotally connected to the frame;

a handle attached to the handle bar.

2. The assembly of claim 1, wherein the frame comprises first and second side rails attached to one another by a strut that is at least substantially perpendicular to the side rails.

3. The assembly of claim 1, further comprising a second roller rotatably mounted to the frame in spaced relation relative to the first roller, wherein a second roller mount is spaced from a lowermost end of the frame.

4. The assembly of claim 3, wherein a shield is disposed adjacent the first roller, the shield further including two projections extending towards the first roller, the projections being spaced from one another.

5. The assembly of claim 4, further comprising a second shield disposed adjacent the second roller.

6. The assembly of claim 3, further comprising a drip guard selectively attached to the frame spaced from the second roller opposite the first roller.

7. The assembly of claim 1, further comprising a standoff associated with the frame disposed above the fluid supply member for inhibiting the fluid supply member from contacting an undesired surface.

8. The assembly of claim 7, wherein the standoff is disposed at the uppermost end of the frame.

9. The assembly of claim 1, further comprising highly flexible, high memory fluid supply line that selectively attaches to the fluid supply member without the use of hand tools.

10. The assembly of claim 1, further comprising a fitting attached to the handle bar and at least one supply line attached to the fitting and communicating with the fluid supply member, wherein the fitting is adapted to receive an associated handle having an internal passage through which fluid travels and the fitting is adjustable so that the orientation of the associated handle is adjustable.

11. The assembly of claim 1, wherein the fluid supply member includes a polygonally shaped portion that is received in a complementarily shaped opening in the frame.

12. The assembly of claim 1, further comprising a fluid supply line, a valve and a fluid source, the fluid supply line being in communication with the fluid supply member and the fluid source, the valve being configured for selectively opening and closing the fluid supply line.

13. The assembly of claim 12, wherein the connection between the fluid supply line and the fluid supply member is a press on connection not requiring the use of hand tools.

* * * * *